US006120032A

United States Patent [19]

Wissinger

[11] Patent Number: 6,120,032

[45] Date of Patent: Sep. 19, 2000

[54] METHOD OF AND ITEMS FOR PLAYING A QUESTION AND ANSWER GAME, USING CLUES BASED ON ALPHANUMERIC RELATIONSHIPS SIMILAR TO A TELEPHONE KEYPAD

[76] Inventor: Jason L. Wissinger, 1542 Adams Ave., Mineral Point, Pa. 15942

[21] Appl. No.: 09/270,705

[22] Filed: Mar. 17, 1999

[51] Int. Cl.[7] ..... A63F 9/18

[52] U.S. Cl. ..... 273/430; 273/292; 273/432

[58] Field of Search ..... 273/429, 430, 273/431, 292

[56] References Cited

U.S. PATENT DOCUMENTS

| | | |
|---|---|---|
| 4,657,248 | 4/1987 | Benaim . |
| 4,679,796 | 7/1987 | Rein . |
| 5,133,560 | 7/1992 | Small . |
| 5,308,079 | 5/1994 | Dreznick et al. . |
| 5,758,877 | 6/1998 | Liddell . |
| 5,895,050 | 4/1999 | Dodd et al. . |

*Primary Examiner*—William M. Pierce

[57] ABSTRACT

A game having a display of alphanumeric combinations, and a device containing at least one category of subjects involving questions and correct answers to said questions in the form of clues provided by the numbers of the alphanumeric combinations contained in the display.

18 Claims, 2 Drawing Sheets

METHOD OF AND ITEMS FOR PLAYING A QUESTION AND ANSWER GAME, USING CLUES BASED ON ALPHANUMERIC RELATIONSHIPS SIMILAR TO A TELEPHONE KEYPAD

FIELD OF THE INVENTION

The present invention relates to a game in which answers are derived by using clues based on predetermined alphanumeric relationships.

BACKGROUND OF THE INVENTION

In the game industry it is common practice to use questions and answers for entertainment and education. Generally, it requires the player to produce the correct answer in a predetermined amount of time. Prior to the development of the present invention, which is a system of clues based on a predetermined alphanumeric relationship, it was common to use various other types of clues, such as an answer statement, as in the Jeopardy®TV game, that invites a "what is" question from contestants. In the Wheel of Fortune®TV game, contestants are provided a category statement, after which the contestants guess at the correct answer by supplying letters of the alphabet to the host in an attempt to spell the answer.

SUMMARY OF THE INVENTION

The present invention is directed to a game that uses a display of numbers that respectively represent groups of letters, and a question concerning at least one category of subjects, the correct answer to said questions being in the form of a series of the numbers that provides clues to the letters that correctly spells the answer. The letter representing numbers can be those found on the familiar telephone keypad.

The game can be furnished in various formats, including but not limited to the following:

A manual board game utilizing a game board with the predetermined alphanumeric relationships displayed, an hourglass type minute timer and one or more packs of question and answer cards. Each card can have one question and clue on the front side and the answer on the reverse side. Each pack of cards can pertain to a specific topic. A supply of score sheets can be included. Additional score sheets and packs of game cards pertaining to a wide range of topics can be made available.

Another type of manual board game similar to that described above except the hourglass timer is replaced by a battery powered timer mounted in the game board or free standing.

An electronic hand held version of the game can have the timer incorporated and the questions and clues made available for display on a screen. Answers are keyed in using an integral keyboard. Scores can also be accumulated using appropriate electronic circuitry and displayed on the screen.

The game of the invention can also be made available as a computer game. A computer game program and a number of questions grouped by topic can be made available on diskette or CD-Rom. Additional questions grouped by topic can also be made available on diskette or CD-Rom.

All of the above embodiments utilize the same unique clue system based on predetermined alphanumeric relationships. In this clue system, the answer is displayed using numbers to represent the required letters, spaces and punctuation. Each number can represent three possibilities, for example. Ten numbers zero through nine depicted on the game board can represent all 26 letters of the alphabet as well as a blank space, an apostrophe, a dash/hyphen and a period.

OBJECTS OF THE PRESENT INVENTION

It is therefore a primary objective of the present invention to provide a game having groups of predetermined topics that provide players of all ages with an opportunity for enjoyment and for enhancing their knowledge of the topics they select for playing.

Another objective of the present invention is to familiarize all ages of people with a predetermined letter/number relationship.

Another object of the present invention is to provide clues that require the players to think about how to decipher the answers using a predetermined alphanumeric system displayed on a game board.

Yet a further objective of the present invention is to improve the player's knowledge of individual numbers, letters, correct spelling and general education.

PREFERRED EMBODIMENTS OF THE INVENTION

Figure 1:
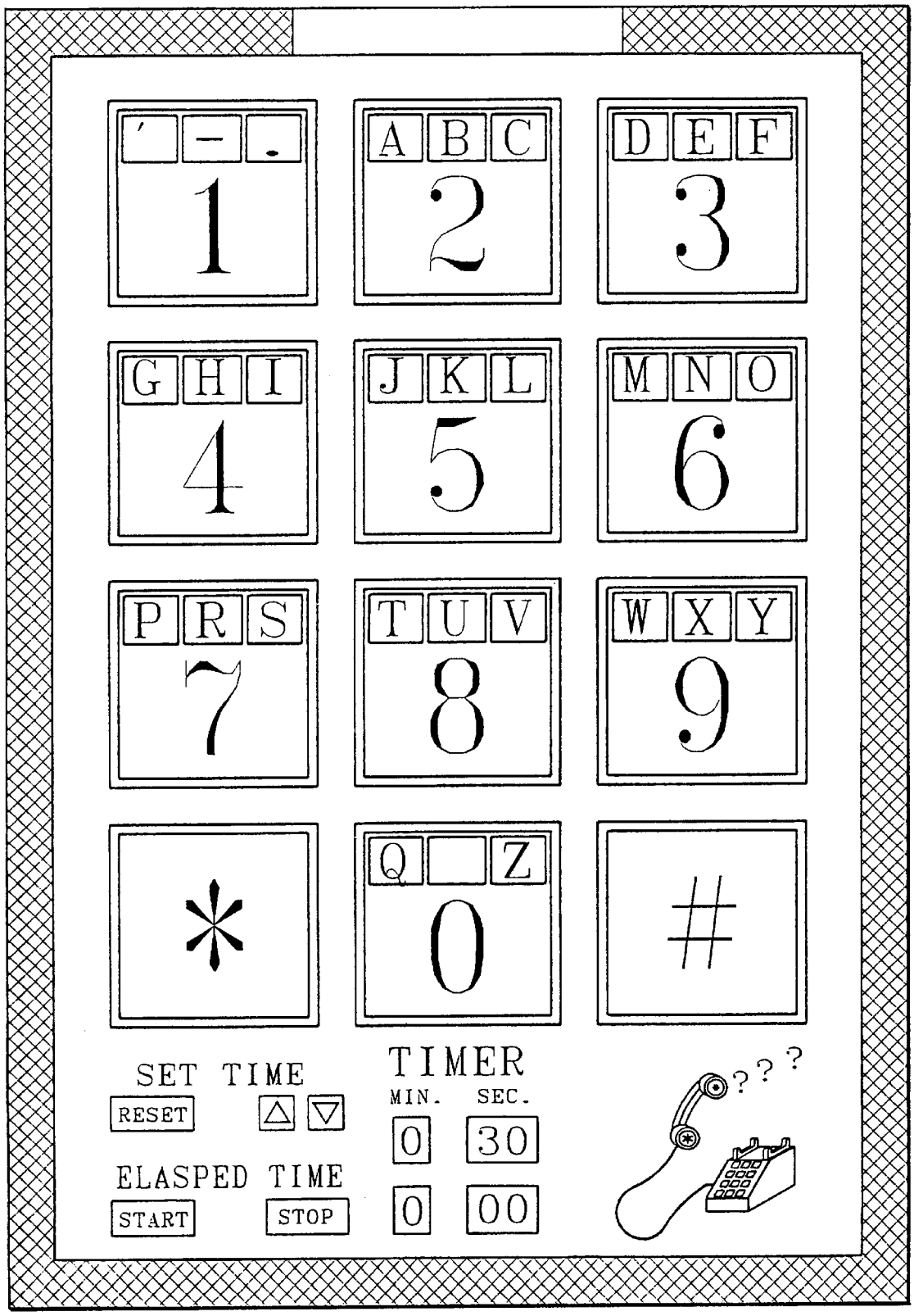
FIG. 1 is a plan view of the game board of the invention showing alphanumeric relationships and a timer arrangement.

Referring now to the FIG. 1 of the drawings, the forward face of a game board or other type of display format 10 is shown in which numbers 1 through 0, such as used on a telephone key pad, represent the entire alphabet by having three letters assigned to each number. The board or display can take the form of a simple, manually handled game board made of a durable material or a sophisticated computer generated display using the screen of a computer monitor.

The computer and screen can be that of the common desk mounted personal computer (PC) variety, or that of a laptop or portable hand held device powered by a battery or low voltage power supply connectable to a house current outlet. The computer can include a chip electronically connected to a unit for reading a disc containing a program that allows players and contestants to play the game of the present invention in the manner described in detail below.

In FIG. 1, each number is located on a large block key, or while three small letter blocks or keys are associated with each number block or key. In an electrical or electronically operated system, the player/contestant can push individual letter keys in attempting to spell a correct answer to a question posed only in terms of the whole numbers (of the number keys). In a manual board, the players guess the letters of the answer using, again, the numbers recited to him or her by another player Further, in the case of the manually handle game board, an hour-glass type of device (not shown) can be provided to time players in the process of providing correct answers to questions posed. In the case of a computer and monitor, or an electronic hand-held device, built-in timing circuits can be used to time contestant time, with an audible sound or numerical clock indication (at 12 in the FIG. 1) on the screen indicating elapsed time in answering a question as well as a time setting and resetting means. As indicated schematically in FIG. 1 by numeral 14, the ringing sound of a telephone can be used to indicate time completion, using audible capabilities of the computer monitor or electronic hand-held device.

Figure 2:
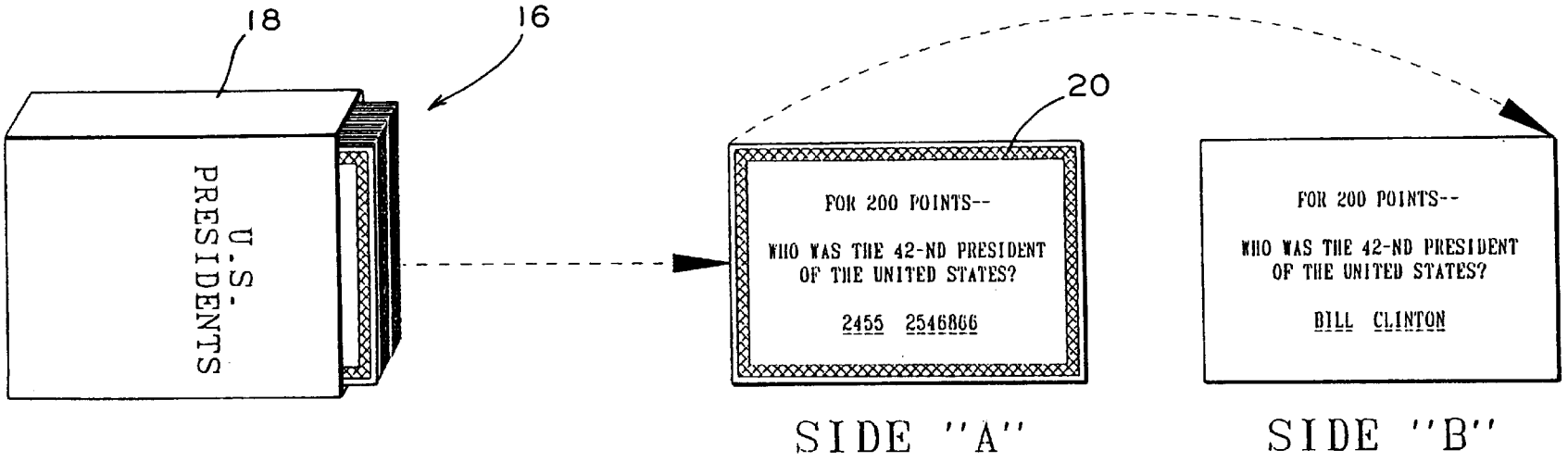
FIG. 2 is an exploded view of a pack of cards contained in a box. The view shows, in addition, one of the cards removed from the box revealing a question and clue on one side (side A) of the card and the answer to the question located on the other side (side B) of the card.

A deck of cards 16 can be used to present questions and clues to correct answers to the players as seen in FIG. 2 of the drawings. Preferably, one face of the card contains one question along with points for correct answers, while the other face of the card contains the answer. The cards are preferably held in an opaque container 18 and face in the same direction so that the contestant cannot see the answer, One member of a group of players can show the question to the contestant or read the question from the card, and provide clues to the answer by reciting the numbers from the board that spell the answer from the three letters associated with and represented by each of the recited numbers. For example, if the question shown or asked of the contestant is "who was the fourth president of the United States?", the person asking the question provides the contestant with numbers 5, 2, 6, 3, 7, 6, 2, 3, 4, 7, 6 and 6, and the contestant can ask the person posing the question: does the first letter of the president's name begins with L? as the letter L is represented by the numeral 5 on the board as well as letters J and K. The person asking the question says "no". The contestant may next ask: is the first letter J. The person asking the question now says "yes". In keeping track of one's answers, the contestant can use a piece of paper to place a number spaced apart, short lines for writing the letters of the answer (James Madison) on the paper. As the contestant places letters on the short lines, he may quickly guess at the correct answer without the need of placing all of the letters of the correct answer on the paper, and well within a time frame allotted for the answer.

As further shown in FIG. 2, the sides or faces of each card can be clearly differentiated to avoid confusion in presenting questions without revealing answers to the questions, i.e., the question side (side A) can have an ornamental border wile the answer side (side B) has no border at al. In the case colors or pictorial identifications, as discussed below, the colors and identifications can be located on one side only.

Preferably, the game of the invention includes a plurality of subjects or categories, which may include the above presidents of the United States. The presidential cards can be colored red, white and blue, for example. Other subjects may include geographical bodies of water (lakes, oceans, rivers), astronomical facts and capital cities of the states of the United States and nations. In the case of bodies of waters, the cards can be colored blue, while cards containing astronomical facts can be provided with a background of stars.

If a dedicated electronic memory type of device is used, the questions can be stored in a memory medium, such a floppy, compact disc or CD-Rom, with the contestant punching keys on a keyboard of the device in attempting to spell the correct answer.

The device can audibly repeat the letter punched and audibly or pictorially say "right" or "wrong" as the player punches the keys after the question is entered into the device.

Again, the player may quickly guess the correct answer from a minimal number of "right" answers he receives from the electronic device in regard to the letter keys he or she punches.

If the category chosen for play is animals, the electronic device (or computer) can be programmed to give the sound of the animal of the question when the player pushes the first letter of the word that spells the name of the animal.

If a manually handled game board is used, the board can be electronically equipped with means to generally light the board and/or letters that are pushed in spelling answers to the questions posed. This means can include a simple low voltage battery (not shown) supplying power to low current light bulbs (not shown), or a low voltage power supply (not shown) connectable to an outlet of house current. Or, light emitting diodes (LEDs) can be located beneath each key; when a key is pushed, electrical connected is made between the power source and to the LED to energize the LED.

While presently preferred embodiments for carrying out the instant invention have been set forth in detail, those persons skilled in game arts to which this invention pertains will recognize various alternative ways of practicing the invention without departing form the spirit and scope of the patent claims appended hereto.

What is claimed is:

1. A game comprising:

a display of of letter and number combinations wherein each number of the letter/number combinations represents a predetermined group of letters, and means separate from the display of the letter/number combination for presenting a subject to a player of the game involving a question and a correct answer to said question, and clues to the correct answer said clues being provided by numbers of the letter/number combinations that represent the letters of the correct answer.

2. The game of claim 1 wherein the display of the letter and number combinations is Presented on a manually manipulatable game board made from a durable material.

3. The game of claim 1 wherein the display of letter/number combinations is digitally stored in memory for use in a computer and for presentation on a computer monitor screen.

4. The game of claim 1 wherein the means for presenting a subject includes a plurality of cards having opposed faces containing a respective plurality of questions, with clues and correct answers to the questions located on the faces of said cards, said questions and clues being on one of said faces and answers located on the other of said faces.

5. The game of claim 4 including means, in addition to the questions and answers located on the respective faces of said cards, that clearly distinguishes one face of each card from the other face to substantially limit confusion between the faces of the cards in presenting questions to a player without the player seeing the answers.

6. The game of claim 4 wherein the cards are contained in an opaque container for sequential removal therefrom in a manner that can present questions to a player of the game without the player seeing the answers contained on the cards.

7. The game of claim 4 wherein the game includes a timing device settable by a player for providing a duration of time within which a player must provide an answer to a given question, with each of said cards containing a designated duration of time within which the answer must be given by the player.

8. The game of claim 7 wherein the settable timing device provides elapsed periods of time within said duration of time.

9. The game of claim 7 wherein the settable timing device includes an audible ringing means which rings when the time provided for answering a question expires.

10. The game of claim 4 wherein the category of questions and answers contained on said cards are directed to presidents of the United States, and the cards are colored red, white and blue.

11. The game of claim 4 wherein the category of questions and answers contained on said cards are directed to geographical bodies of water, and the cards are colored blue.

12. The game of claim 4 wherein the category of questions and answers are directed to astronomical facts, with a background of stars provided on one side of said cards.

13. The game of claim 1 wherein the category of said subjects is capital cities of the states of the United States.

14. The game of claim 1 wherein the category of subjects is capital cities of respective nations.

15. The game of claim 1 wherein the questions and answers are stored in a memory of a dedicated hand-held electronic device.

16. The game of claim 1 wherein letter sets of the combinations of letters/numbers are presented on the keyboard of a computer and are each provided with a picture of an item, the first letter of the spelling of said item being in one of the letter sets.

17. The game of claim 16 wherein the memory contains the correct spelling of the words of said pictures depicted with the letter sets, and the computer is provided with an audible and/or visual capability that provides the correct spelling of the words for the players of the game.

18. A game apparatus comprising:

a game board having a layout of a telephone keyboard wherein single numbers represent a group of letters, and at least one category of subjects involving questions and answers to said questions wherein the answers are provided in the form of representative numbers selected from the numbers found on the game board, the correct answer to a given question being determined by a combination of said numbers that represent the letters that correctly spell the answer.

* * * * *